US007046938B2

(12) United States Patent
Yamamoto et al.

(10) Patent No.: US 7,046,938 B2
(45) Date of Patent: May 16, 2006

(54) IMAGE FORMING APPARATUS

(75) Inventors: Satoru Yamamoto, Ibaragi (JP); Eiichi Motoyama, Tokyo (JP); Shokyo Koh, Ibaragi (JP); Mitsuhiko Sato, Chiba (JP); Takashi Fujimori, Ibaragi (JP); Hidenori Sunada, Ibaragi (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 10/693,103

(22) Filed: Oct. 27, 2003

(65) Prior Publication Data

US 2004/0136754 A1 Jul. 15, 2004

(30) Foreign Application Priority Data

Oct. 31, 2002 (JP) ..... 2002-317753

(51) Int. Cl.
*G03G 15/00* (2006.01)

(52) U.S. Cl. ..... 399/82; 399/38; 399/43; 399/85; 399/299

(58) Field of Classification Search ..... 399/82, 399/75, 85, 43, 223, 228, 38, 54, 53, 66, 399/298, 299, 300, 302
See application file for complete search history.

(56) References Cited

U.S. PATENT DOCUMENTS

| | | | | |
|---|---|---|---|---|
| 5,386,286 | A * | 1/1995 | Kinouchi et al. | 399/228 |
| 5,592,305 | A | 1/1997 | Iwadate et al. | 358/448 |
| 5,765,082 | A * | 6/1998 | Numazu et al. | 399/299 |
| 6,120,197 | A | 9/2000 | Kawamoto et al. | 400/61 |
| 6,324,374 | B1 * | 11/2001 | Sasamoto et al. | 399/298 |
| 6,453,139 | B1 | 9/2002 | Sasame et al. | 399/167 |
| 6,738,594 | B1 * | 5/2004 | Nakagawa et al. | 399/299 |
| 2003/0026626 | A1 | 2/2003 | Sunada et al. | 399/82 |

FOREIGN PATENT DOCUMENTS

| | | |
|---|---|---|
| JP | 10-285421 | 10/1998 |
| JP | 2001-305818 | 11/2001 |

* cited by examiner

*Primary Examiner*—Sophia S. Chen
(74) *Attorney, Agent, or Firm*—Fitzpatrick, Cella, Harper & Scinto

(57) ABSTRACT

The present invention provides an image forming apparatus which, when switching operation from color image forming operation to monochromatic image forming operation, forms a monochromatic image on each of a prescribed number of sheets by stopping a part of the functions of yellow, magenta and cyan image forming sections of the color image forming operation, and thereafter, forms a monochromatic image only with a black-only image forming section, thereby permitting extension of service life of the image forming sections, while improving the productivity.

14 Claims, 10 Drawing Sheets

IMAGE FORMING APPARATUS

BACKGROUND OF THE INVENTION

1. Field of the Invention

The present invention relates to an image forming apparatus, having a plurality of image forming sections, for forming an image by the electrophotographic method or the electrostatic recording method, suitably applicable when improving productivity and machine service life regarding image forming upon forming image read out from a color mixed black-white original (original comprising a mixture of color and monochromatic originals) or from color-monochromatic data read out from a computer onto a recording medium such as paper.

2. Description of the Related Art

A conventional color image forming apparatus has been based on a process of multi-transferring images onto a recording medium while sequentially conveying a plurality of image forming sections on a conveyor belt, or multi-transferring images on an intermediate transfer belt and then transferring all at once on a recording medium.

A color image forming apparatus of this type has control means that switches over the mode between a color image forming mode for forming a color image on a recording medium in response to a read image of the original, and a monochromatic image forming mode for forming a monochromatic image on the recording medium. In such a color image forming apparatus, when a single color original and monochromatic originals are processed at the same time, image forming is performed in the color image forming mode, including for the monochromatic originals, since the single color original requires driving of image forming sections for colors (a yellow recording unit, a cyan recording unit, and a magenta recording unit), even though driving of color image forming sections are not usually required for image forming of a monochromatic original. This reduces the service life of the color image forming sections.

For the purpose of coping with the above-mentioned problem, Japanese Patent Application Laid-Open No. 10-285421 proposes a technique of switching over the mode between a color image forming mode and a monochromatic image forming mode in page units, and processing a monochromatic original in the monochromatic image forming mode, thereby improving durability.

The mode is switched over between the color image forming mode and the monochromatic image forming mode. When mode switching is frequent, therefore, switching takes much time, thus leading to a problem of decreased productivity.

In Japanese Patent Application Laid-Open No. 2001-305818 the frequency of mode switching between the color image forming mode and the monochromatic image forming mode is reduced and the productivity of image forming is improved by determining the number of monochromatic images for which continuous image forming is currently underway, and switching over the mode from the color image forming mode to the monochromatic image forming mode on the basis of the result of such a determination. However, while an increase in the number of formed images determined as described above improves productivity, this increase reduces the machine service life of the color image forming sections. On the other hand, a smaller number of formed images determined as above leads to a higher switching frequency between the color image forming mode and the monochromatic image forming mode, thus permitting achievement of a longer service life. This, however, leads to a lower productivity.

In order to achieve a running cost at or below a prescribed level, while maintaining a high productivity of image forming, it has been necessary to provide sufficient room for machine service life. This has required the use of expensive parts each having a sufficient service life for all portions that may be deteriorated when forming images in the color image forming mode. In order to achieve a prescribed running cost when using short-life parts, in contrast, it has been impossible to improve productivity of image forming.

SUMMARY OF THE INVENTION

The present invention has been developed in view of the above-mentioned problems, and provides an image forming apparatus which permits achievement of a longer machine service life while improving productivity of image forming and reducing running cost.

More specifically, the present invention provides an image forming apparatus comprising:

- first image forming means which controls at least two image forming sections from among a plurality of image forming sections to form an image by superimposing a plurality of colors;
- second image forming means which controls a single image forming section from among the plurality of image forming sections to form a monochromatic image;
- third image forming means which controls the single image forming section used by the second image forming means, and partially stops operation of the remaining image forming sections, to form a monochromatic image; and
- control means which, when causing image forming of the monochromatic image by the second image forming means by switching over the first image forming means to the second image forming means, causes image forming of the monochromatic image by the third image forming means only during a prescribed period of time.

The present invention also provides an image forming apparatus comprising:

- first image forming means which superimposes images of a plurality of colors by controlling two or more image forming sections from among a plurality of image forming sections;
- second image forming means which forms a monochromatic image by controlling a single image forming section from among the plurality of image forming sections;
- third image forming means which forms a monochromatic image by controlling the single image forming section used by the second image forming means and partially stopping operation of the remaining image forming sections; and
- control means which, when causing image forming of the monochromatic image by the second image forming means by switching over the first image forming means to the second image forming means during image forming of a multi-color image by the first image forming means, causes image forming of monochromatic images only in a prescribed number by the third image forming means, and then causes image forming of a monochromatic image by the second image forming means.

The present invention also provides an image forming apparatus comprising:

first image forming means which forms an image by superimposing a plurality of colors by controlling two or more image forming sections from among a plurality of image forming sections;

second image forming means which forms a monochromatic image by controlling a single image forming section from among the plurality of image forming sections;

third image forming means which forms a monochromatic image by controlling the single image forming section used by the second image forming means and partially stopping operation of the remaining image forming sections; and control means which, when causing image forming of the monochromatic image by the second image forming means by switching over the first image forming means to the second image forming means during image forming of images of a plurality of colors by the first image forming means, causes image forming of monochromatic images by the third image forming means, and then controls driving of the operation of the image forming sections stopped by the third image forming means.

Further objects, features and advantages of the present invention will become apparent from the following description of the preferred embodiments with reference to the attached drawings.

DESCRIPTION OF THE PREFERRED EMBODIMENTS

Figure 1:
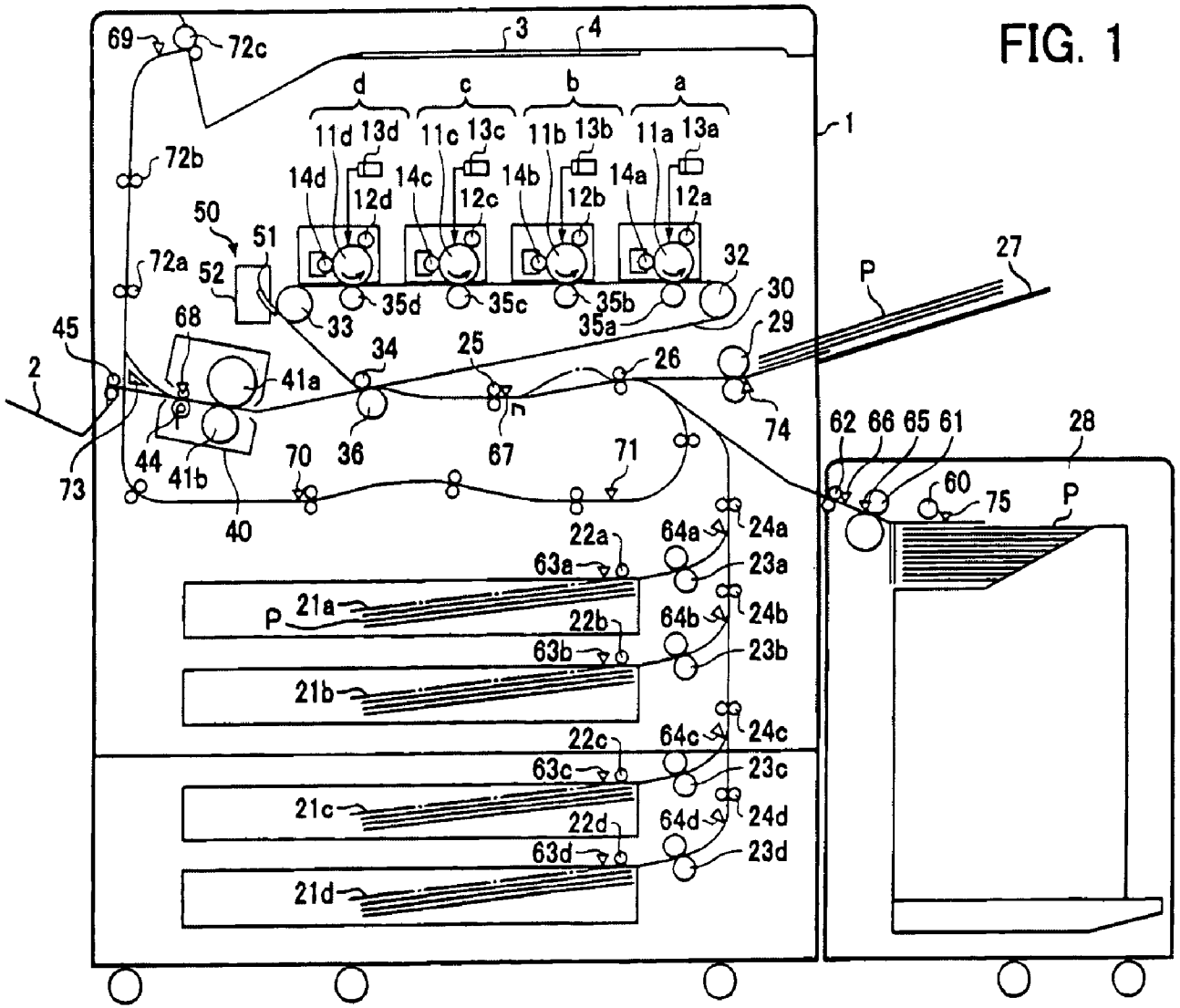
FIG. 1 is a configuration diagram illustrating a schematic longitudinal sectional structure of the image forming apparatus of a first embodiment of the present invention.

Embodiments of the present invention will now be described in detail with reference to the drawings. Reference numerals common to drawings represent the same component members, and duplication of description is omitted.

[First Embodiment]

<Entire Configuration of Image Forming Apparatus>

The entire configuration of the image forming apparatus of a first embodiment of the present invention will be described. FIG. 1 is a configuration diagram illustrating a schematic longitudinal sectional structure of the image forming apparatus of the first embodiment of the invention. The image forming apparatus 1 is a copying machine which forms an image on a recording medium by the electrophotographic method on the basis of an image read out from an original, and can perform communication with an external device (not shown) such as a computer via a network and thus obtain image data.

The image forming apparatus 1 broadly comprises an image forming section (having four stations a, b, c and d corresponding to four colors described later, arranged in parallel, with identical configurations), a paper feed section, an intermediate transfer section, a conveying section, an operating section, and a control unit (not shown). As image forming means, there are available first image forming means (color image forming operation mode: a mode in which an image is formed on the recording medium by two or more image forming sections from among a plurality of image forming sections), second image forming means (monochromatic image forming operation mode: a mode in which an image is formed on the recording medium by a single, for example only a single black, image forming section from among the plurality of image forming sections), and third image forming means (a mode in which, when the color image forming operation mode is switched over to the monochromatic image forming, an image is formed by partially stopping the operation of the image forming section switched over from the color image forming operation mode). The above-mentioned second and third image forming means will hereafter be referred to as a monochromatic image forming operation mode.

Individual units of the image forming apparatus 1 will now be described. First, the image forming sections will be described in detail. An image forming section has the following configuration. Photosensitive drums 11*a*, 11*b*, 11*c* and 11*d* serving as image carriers are bearing-supported at the center, and rotation-driven by a driving motor (not shown) in the arrow direction in the drawing. Roller chargers 12*a*, 12*b*, 12*c* and 12*d* for charging the surfaces of the photosensitive drums, scanners 13*a*, 13*b*, 13*c* and 13*d* which expose the photosensitive drum surfaces, and developing units 14*a*, 14*b*, 14*c* and 14*d* for developing electrostatic latent images on the photosensitive drums are arranged in a state facing the outer peripheral surfaces of the photosensitive drums 11*a* to 11*d* in the rotating direction thereof.

In order to form an image, the roller chargers 12*a* to 12*d* charge a uniform amount of charge to the surfaces of the photosensitive drums 11*a* to 11*d*. Then, electrostatic latent images are formed on the photosensitive drums 11*a* to 11*d* by exposing the photosensitive drums 11*a* to 11*d* to light such as a laser beam, modulated by the scanners 13*a* to 13*d* having rotary polygonal mirrors in response to a recorded image signal. The developing units 14*a* to 14*d*, which house developing agents (toner) of four colors such as yellow, cyan, magenta and black, convert the above-mentioned latent images into sensible images. Visible images thus converted into sensible images are transferred to an intermediate transfer belt 30. Images are thus sequentially formed by each toner through the image forming process described above.

The paper feed section will now be described in detail. The paper feed section comprises a portion housing a recording medium P (including paper feed cassettes 21*a*, 21*b*, 21*c* and 21*d*, a hand-inserting tray 27, and a deck 28), a roller for conveying the recording medium P, a sensor for detecting passage of the recording medium P, a sensor for detecting presence of the recording medium P, and a guide (not shown) for causing conveyance of the recording medium P along a conveying path. The paper feed cassettes 21*a*, 21*b*, 21*c* and 21*d* house the recording media P for automatic paper feeding. The hand-inserting tray 27 is for placing the recording medium P for hand-insertion. The deck 28 houses the recording medium P for automatic paper feeding. Pickup rollers 22*a*, 22*b*, 22*c* and 22*d* deliver the recording medium P sheet by sheet from the paper feed cassettes 21*a* to 21*d*. Even when a plurality of sheets of the recording medium P are delivered by the pickup rollers 22*a* to 22*d*, a single sheet of the recording medium P is separated certainly by each of paper feed rollers (BC rollers) 23*a*, 23*b*, 23*c* and 23*d*.

The single sheet of recording medium P separated by each of the paper feed rollers 23*a* to 23*d* from among the plurality of sheets of recording medium P housed in the paper feed cassettes 21*a* to 21*d* is further conveyed by pull-through rollers 24*a* to 24*d* and a pre-registration roller 26 to a registration roller 25. A sheet of the recording medium P housed in the hand-insertion tray 27 is separated by a BC roller 29, and conveyed by the pre-registration roller 26 to the registration roller 25. A plurality of sheets of the recording medium P housed in the deck 28 are conveyed by a pickup roller 60 to a paper feed roller 61. A single sheet is separated certainly by the paper feed roller 61, and conveyed to the pull-through roller 62. Then, the recording medium P is conveyed by the pre-registration roller 26 to the registration roller 25.

The intermediate transfer section will now be described in detail. The intermediate transfer belt 30 is made of PET (polyethyleneterephthalate) or PVdF (polyvinylidene fluoride). A driving roller 32 transmits a driving force to the intermediate transfer belt 30. In the driving roller 32, which is made of metal slip relative to the intermediate transfer belt 30 is prevented by coating rubber (urethane or chloroprene) having a thickness of several mm to the surface of the metal roller. The driving roller 32 is rotation-driven by a stepping motor (not shown). A tension roller 33 gives an appropriate tension imparted by a spring (not shown) to the intermediate belt 30. A driven roller 34 forms a secondary transfer area by holding the intermediate transfer belt 30 with a secondary transfer roller 36 described later. The intermediate transfer belt 30 is supported by the driving roller 32, the tension roller 33 and the driven roller 34, and driven to circulate along the outer peripheries of these rollers.

Primary transfer rollers 35*a* to 35*d* to which a high voltage for transferring a toner image onto the intermediate transfer belt are arranged respectively on the back of the intermediate transfer belt 30 at each position where the photosensitive drums 11*a* to 11*d* and the intermediate transfer belt 30 face each other. A secondary transfer roller 36 is arranged oppositely to the driven roller 34, and forms a secondary transfer area by a nip with the intermediate transfer belt 30. The secondary transfer roller 36 is pressed under an appropriate pressure against the intermediate transfer belt 30. A cleaning unit 50 for cleaning the image forming surface of the intermediate transfer belt 30 is arranged downstream of the secondary transfer area of the intermediate transfer belt 30. The cleaning unit 50 comprises a cleaner blade 51 (made of polyurethane rubber or the like) and a waste toner box 52 which receives waste toner.

A fixing unit will now be described in detail. A fixing unit 40 comprises a fixing roller 41*a* having therein a heat source such as a halogen heater, a pressing roller 41*b* pressed by the fixing roller 41*a* (this pressing roller 41*b* may also have a heat source), and an internal paper discharge roller 44 which conveys the recording medium P discharged from the roller pair comprising the above-mentioned fixing roller 41*a* and the pressing roller 41*b*. The fixing unit 40 fixes an image on the recording medium P having the image transferred from the intermediate transfer belt 30 by means of the fixing roller 41*a* and the pressing roller 41*b*, and then discharges the recording medium P by means of the internal paper discharge roller 44.

The conveying section will now be described in detail. The recording paper is fed from any of the paper feed cassettes 21*a* to 21*d*, the hand-insertion tray 27, and the deck 28, and conveyed to the registration roller 25. Conveyance is discontinued by stopping rotation driving of the rollers upstream of the registration roller 25. Rotation driving of the rollers upstream of the registration roller 25 is resumed in line with the image forming timing of the image forming section. The recording medium P is delivered to the secondary transfer area defined by the intermediate transfer belt 30 and the secondary transfer roller 36. In the secondary transfer area, the image on the intermediate transfer belt 30 is transferred. The recording medium P onto which the image is fixed in the fixing unit 40 passes through the internal discharge roller 44, and the destination of conveyance is switched over by a switching flapper 73.

When the switching flapper 73 is set on a face-up paper discharge side, the recording medium P is discharged by an external paper discharge roller 45 into a face-up paper discharge tray 2. On the other hand, when the switching flapper 73 is set on a face-down paper discharge side, the recording medium P is conveyed toward reversing rollers 72*a*, 72*b* and 72*c*, and discharged into a face-down paper discharge tray 3. A plurality of sensors for detecting passage of the recording medium P are arranged on the conveying path of the recording medium P.

The above-mentioned plurality of sensors include paper feed retry sensors 64*a*, 64*b*, 64*c* and 64*d* which respectively detect paper feeding of the recording medium P from the paper feed cassettes 21*a*, 21*b*, 21*c* and 21*d*; a deck paper feed sensor 65 which detects paper feeding of the recording medium P from the deck 28; a deck pull-through sensor 66; a registration sensor 67 which detects conveyance of the recording medium P to the intermediate transfer section; an internal paper discharge sensor 68 which detects passage of the recording medium P in the internal paper discharge roller 44; a face-down paper discharge sensor 69 which detects discharge of the recording medium P into the face-down paper discharge tray 3; a two-side pre-registration sensor 70 which detects the recording medium P to be printed on two sides, conveyance of which recording medium to the intermediate transfer section is kept waiting in standby; and a two-side paper re-feed sensor 71 which detects paper re-feed of the recording medium P to be printed on two sides.

Paper feed cassette paper presence sensors 63*a*, 63*b*, 63*c* and 63*d* which detect presence or absence of the recording medium P are respectively arranged in the paper feed cassettes 21*a* to 21*d* housing the recording medium P. A hand-insertion tray paper presence sensor 74 which detects presence or absence of the recording medium P on the hand-insertion tray 27 is arranged in the hand-insertion tray 27. A deck paper presence sensor 75 which detects presence or absence of the recording medium P in the deck 28 is arranged in the deck 28.

A control unit will now be described. The control unit is arranged in the image forming apparatus 1, and comprises control circuit boards (not shown) for controlling the operation of mechanisms in the above-mentioned units (the paper feed section, the intermediate transfer section, the conveying section, the fixing unit, and the operating section), and motor drive circuit boards (not shown) which drive various motors. Detailed description of the control circuit boards and the motor drive circuit boards is omitted.

The operating section will now be described. The operating section 4 is arranged on the upper surface of the enclosure of the image forming apparatus 1, and has a display section and various keys (not shown). Selection of any of the paper feed sections (the paper feed cassettes 21*a* to 21*d*, the hand-insertion tray 27 and the deck 28), selection of any of the paper discharge trays (the face-up paper discharge tray 2 and the face-down paper discharge tray 3), and specification of a tab paper bundle to be covered by image forming (a bundle of recording medium sheets having tabs) can be performed from the operating section 4.

The image forming apparatus will now be described in detail with reference to the operation thereof. A case where an image is formed by conveying the recording medium P from the paper feed cassette 21*a* will be described as an example. Upon the lapse of a prescribed period of time after issuance of an image forming operation start signal, the recording medium P is delivered sheet by sheet from the paper feed cassette 21*a* by the pickup roller 22*a*. The recording medium P is conveyed by the paper feed roller 23*a* to the registration roller 25 via the pull-through roller 24*a* and the pre-registration roller 26. The registration roller 25 stops at this point in time, and the leading end of the recording medium P hits the nip portion of the registration roller 25. Thereafter, the registration roller 25 begins rotating in line with the start timing of image forming by the image forming section. This timing of rotation is set so that the recording medium P and the toner image primary-transferred onto the intermediate transfer belt 30 from the image forming section are in agreement in the secondary transfer area.

Upon issuance of the image forming operation start signal, the toner image formed on the photosensitive drum lid in the uppermost stream in the rotating direction of the intermediate transfer belt 30 is primary-transferred onto the intermediate transfer belt 30 in the primary transfer area by the transfer roller 35*d* to which a high voltage is impressed through the above-mentioned process. The toner image primary-transferred on the intermediate transfer belt 30 is conveyed to the next primary transfer area. In the next primary transfer area, an image is formed during a delay of a period of time while the toner image is conveyed between the individual image forming sections, and the next toner image is transferred by aligning the leading end of the image with the preceding image. Subsequently, a similar process is repeated, and finally, toner images of the four colors are primary-transferred on the intermediate transfer belt 30.

Thereafter, when the recording medium P advances into the secondary transfer area and comes into contact with the intermediate transfer belt 30, a high voltage is impressed to the secondary transfer roller 36 in line with the timing of passage of the recording medium P, and the four-color toner image formed on the intermediate transfer belt by the above-mentioned process is transferred onto the surface of the recording medium P. The recording medium P is guided to the nip portion formed by the fixing roller 41*a* and the pressing roller 41*b* of the fixing unit 40, and a toner image is fixed to the surface of the recording medium under the effect of the heat of the fixing roller 41*a* and the pressing roller 41*b* and under pressure of the nip portion. Subsequently, the recording medium P is discharged into the face-up paper discharge tray 2 or the face-down tray 3 in response to the switching direction of the switching flapper 73.

In the image forming apparatus 1, an original reading section (not shown) for reading an image from the original to be duplicated is arranged on the enclosure. The original reading section comprises an original glass table on which the original is placed; a reading unit having an original illuminating lamp for irradiating light onto the original on the original glass table and a mirror guiding the reflected light from the original; a plurality of mirrors guiding the light from the reading unit; a lens guiding the reflected light from the mirror; and an image sensor such as a CCD for photoelectric conversion of the optical image formed by the lens into an electric signal. An automatic original feeder (ADF) which automatically feeds the originals separated sheet by sheet from an original bundle set on the original bundle loading section to a reading position on the original glass table may be additionally installed. In FIG. 1, the original reading section is not shown.

<Controller Configuration>

Figure 2:
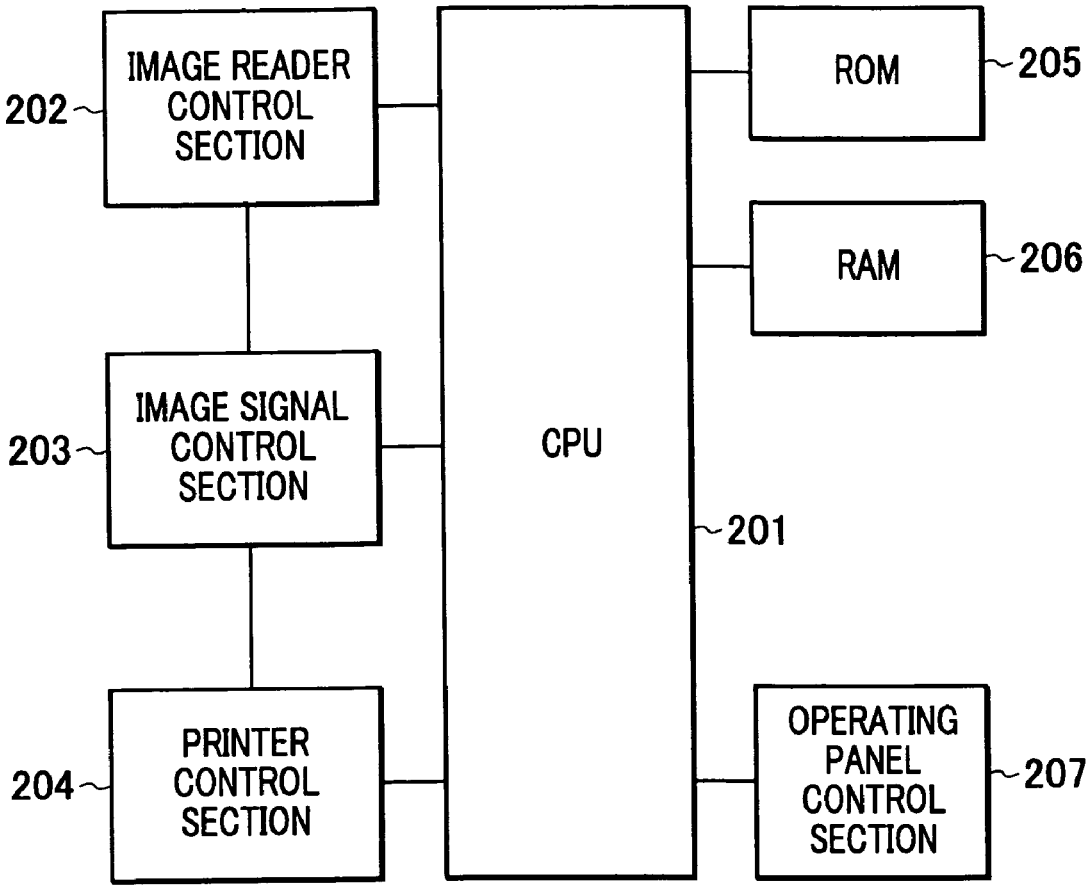
FIG. 2 is a block diagram illustrating the configuration of the controller of the image forming apparatus.

The configuration of the controller of the image forming apparatus 1 will now be described. FIG. 2 is a block diagram illustrating the configuration of the controller which controls the image forming apparatus 1. The controller comprises a CPU 201, an image reader control section 202, an image signal control section 203, a printer control section 204, ROM 205, RAM 206, and an operating panel control section 207.

The CPU 201 controls the image forming apparatus 1 as a whole through control of the original reading section via the image reader control section 202, control of execution of the individual operation modes, and execution of the processing shown in a flowchart described later by executing a control program stored in the ROM 205. The CPU 201 determines whether the original read out by the original reading section is a color original or a monochromatic original, and determines the number of sheets of the color original and the monochromatic original. In the host computer-printer system, the CPU 201 may determine whether the original is color or monochromatic, and the number of sheets of the color data and monochromatic data on the basis of a signal from the host. On the basis of the result of determination, the CPU 201 performs control for switching over to any of the first image forming means, the second image forming means and the third image forming means. In this case, the setting is such that the switching time from the third image forming means to the first image forming means is shorter than the switching time from the second image forming means to the first image forming means.

The image reader control section 202 controls the original reading operation by the original reading section. The image signal control section 203 accumulates image data of the original read from the original reading section or image data entered into the image signal control section 203 from an external device via the network, and outputs print data to a printer control section 204. The printer control section 204 controls paper feed operation of the recording medium by the paper feed section, conveying operation of the recording medium, charging, exposing and developing operation by the image forming section, transfer operation by the intermediate transfer section, and fixing operation by the fixing unit, on the basis of the print data outputted by the image signal control section 203. The ROM 205 stores control programs executed by the CPU 201. The RAM 206 provides working areas to the CPU 201. The operating panel control section 207 performs display control and keying control of the operating section (operating panel) 4.

<Operation of Image Forming Apparatus>

Figure 3:
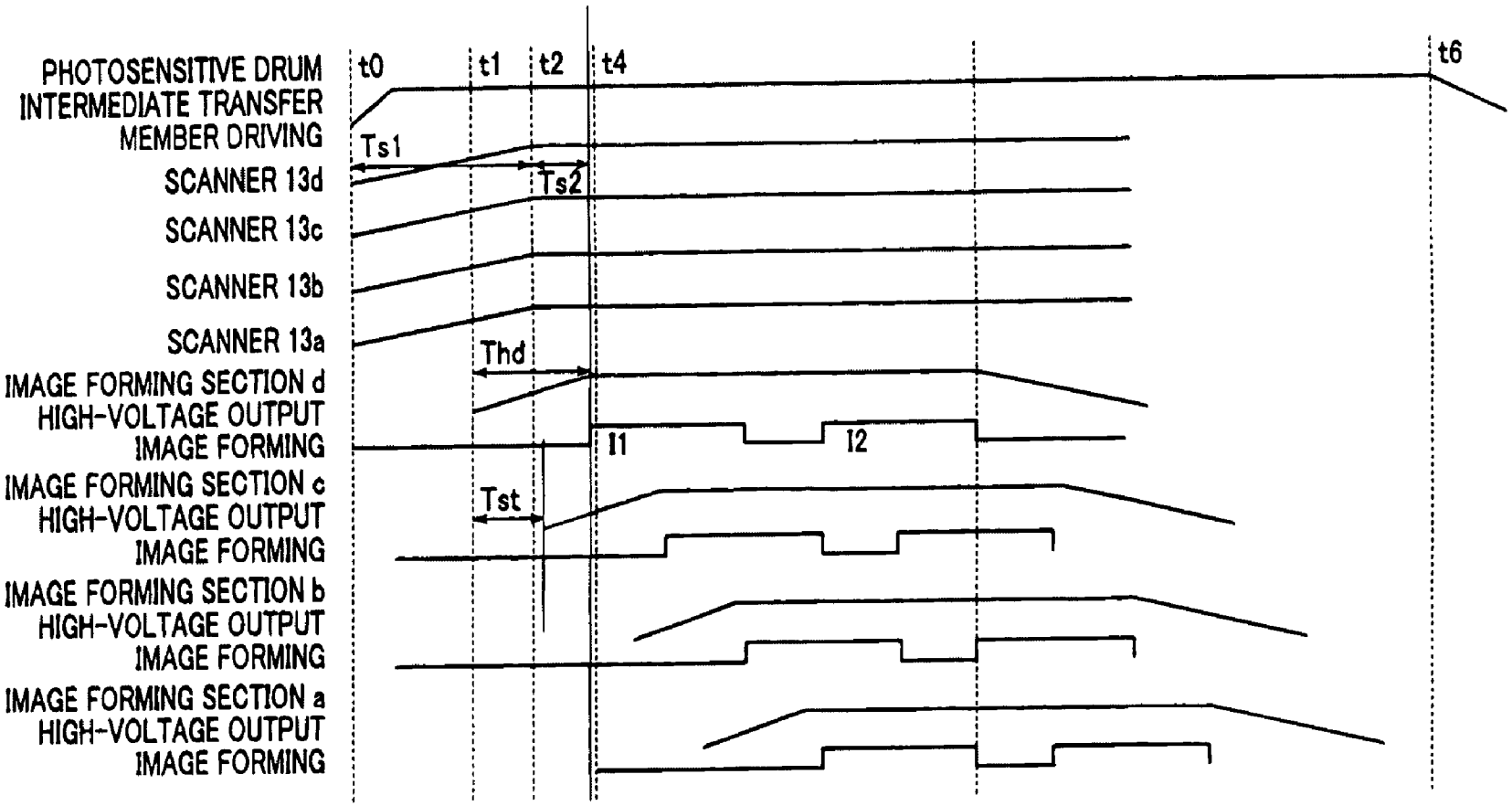
FIG. 3 is a timing chart illustrating the control timing of the image forming section in the case of a color image forming operation of the image forming apparatus.

Operation of the image forming apparatus 1 will now be described with reference to FIGS. 3 to 6. Control of the image forming sections a to d during color image forming operation of the image forming apparatus 1 will first be described with reference to the timing chart of FIG. 3. FIG. 3 is a timing chart illustrating the control timing of the image forming sections a to d during color image forming operation.

Upon issuance of an image forming operation start signal, the photosensitive drums 11*a* to 11*d* and the intermediate transfer belt 30 are driven for rotation (timing t0). Rotation driving of the scanners 13*a* to 13*d* is also started. The scanners 13*a* to 13*d* are controlled so as to be rotated at a certain speed through acceleration to a prescribed speed for a time Ts1. After controlling the scanners 13*a* to 13*d* to a certain speed (timing t2), synchronization processing (time Ts2) is conducted so that the individual scanners 13*a* to 13*d* are driven with respective differences in rotation angle. By adjusting and maintaining these differences in rotation angle, when transferring and layering images of four colors formed by the image forming sections a to d onto the intermediate transfer belt 30, positions of colors are aligned.

After starting rotation driving of the scanners 13*a* to 13*d*, preparations for forming an image of the image forming section d is started at a timing t1. In the image forming section, as described above as to the image forming process, high voltages for forming an image are sequentially outputted, which is a known technique. A high voltage is applied to the roller charger 12*d* so as to give a uniform charge to the surface of the photosensitive drum 11*d* by the roller charger 12*d*. For example, a DC voltage and an AC voltage are impressed, and this represents a known technique.

Subsequently, a high voltage is applied to the developing unit 14*d* at the moment when the surface of the photosensitive drum 11*d* charged by the roller charger 12*d* reaches the position of the developing unit 14*d*. Similarly, a voltage necessary for transferring is impressed onto the primary transfer roller 35*d* when the surface of the photosensitive drum lid reaches the position of the primary transfer roller 35*d*. Then, preparations for image forming are completed. Upon impression of the above-mentioned high voltages, a risetime is required before impression of necessary voltage (high voltage). Determining other output timings by considering the individual risetimes is known in the conventional art. The preparations for image forming of the image forming section d are thus completed in a time Thd shown in FIG. 3.

The timing t1 of starting the preparations for image forming of the image forming section d is determined from the preparation time of the scanners 13*a* to 13*d*, Ts1+Ts2, and the image forming preparation time Thd. Since, in the example shown in FIG. 3, Ts1+Ts2>Thd, this results in:

$$(Ts1+Ts2-Thd)=(t1-t0).$$

Examples include Ts1 of about 2.5 seconds, Ts2 of about 1 second, and Thd of about 1.4 seconds, and this leads to (t1−t0) of about 2.1 seconds. In this embodiment, Ts1 and Ts2 have been described as having constant values. However, Ts1 and Ts2 may be different, depending upon control of the scanners 13*a* to 13*d*. In this case, t1 is determined with an expected time of Ts1+Ts2.

Upon the completion of the preparations for the scanners 13*a* to 13*d* and the image forming preparations of the image forming section d, image forming I1 is started (timing t4). In the example shown in FIG. 3, image forming is represented by a timing chart of image forming of a recording medium of two pages. After the lapse of a prescribed interval from image forming I1, image forming I2 is carried out. After timing t1, preparations for image forming of the image forming section c are started after the lapse of time Tst which is the interval between the stages of the image forming sections a to d. Preparations for image forming of the image forming section b are started after the lapse of time Tst, and after the further lapse of time Tst, preparations for image forming of the image forming section a are started. Image forming operation of the image forming sections c, b and a is conducted sequentially at intervals of time Tst between the individual stages of the image forming sections a to d starting from timing t4.

Upon the completion of image forming for necessary pages, the image forming section d executes end processing of image forming which is a known technique. This sequentially causes the end of impression of a high voltage in contrast to the preparation for image forming. Subsequently, at timing t6 when it is no longer necessary to drive the photosensitive drums 11*a* to 11*d* and the intermediate transfer belt 30, driving of the photosensitive drums 11*a* to 11*d*, the intermediate transfer belt 30 and the scanners 13*a* to 13*d* is discontinued. Prerequisites for timing t6 are that end processing of all the image forming sections a to d has been completed, and that the recording medium P has passed through the gap between the driven roller 34 and the secondary transfer roller 36, and post-processing such as cleaning of the intermediate transfer belt 30 has been completed.

<Black-only Image Forming Operation>

Figure 4:
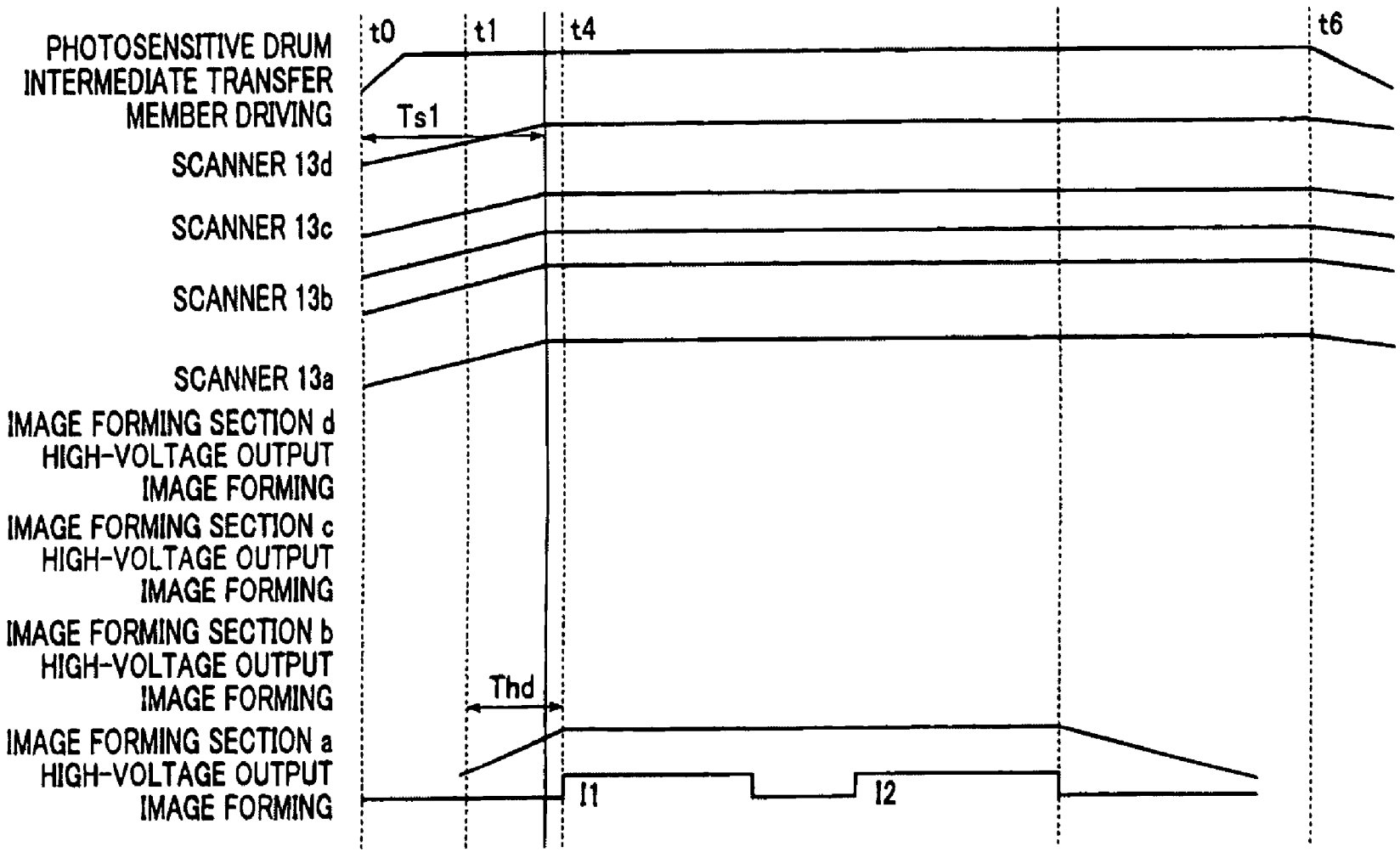
FIG. 4 is a timing chart illustrating the control timing of the image forming section in the case of a black-only image forming operation of the image forming apparatus.

The control timing of the image forming sections a to d during black-only image forming operation of the image forming apparatus 1 will now be described with reference to the timing chart shown in FIG. 4. FIG. 4 is a timing chart illustrating the control timing of the image forming sections a to d during black-only image forming operation.

When an image forming operation start signal is issued, the photosensitive drums 11*a* to 11*d* and the intermediate transfer belt 30 are driven for rotation (timing t0). Rotation driving of the scanners 13*a* to 13*d* is also started. The scanners 13*a* to 13*d* are controlled to a certain speed through acceleration to a prescribed speed for time Ts1. Since this is a black-only image forming operation, it is not necessary to conduct synchronizing processing for the scanners 13*a* to 13*d*. Omission of the synchronizing processing permits reduction of the image forming starting time.

At timing t1 after start of driving of the scanners 13*a* to 13*d*, preparations for image forming of the image forming section a are started. Since this is the black-only image forming operation in this case also, it is not necessary to conduct preparations for image forming for the other three colors. In this embodiment, the image forming section a forming the image transferred last onto the intermediate transfer belt 30 corresponds to black. As a result, in the case of black-only image forming operation, the time from image forming (charging, exposing and developing) to the transfer to the recording medium P in the secondary transfer area can be reduced to a third of the time between the individual stages of the image forming sections a to d.

Preparations for image forming of the image forming section a are the same as in the example shown in FIG. 3. Timing t1 for starting preparation for image forming of the image forming section a is determined from the preparation time Ts1 of the scanners 13*a* to 13*d* and the image forming preparation time Thd. In the example shown in FIG. 4, Ts1>Thd leads to (Ts1−Thd)=(t1−t0).

Upon the completion of the preparations for the scanners 13*a* to 13*d* and image forming preparations of the image forming section a, image forming I1 is started (timing t4). In the example shown in FIG. 4, image forming is represented by the timing chart for image forming of two pages of the recording medium P. After the lapse of a prescribed interval from image forming I1, image forming I2 is carried out. Upon the completion of image forming of necessary pages, the image forming section d performs end processing of image forming which is a known technique.

At timing t6 when it becomes unnecessary to drive the photosensitive drums 11*a* to 11*d* and the intermediate transfer belt 30, driving of the photosensitive drums 11*a* to 11*d*, the intermediate transfer belt 30 and the scanners 13*a* to 13*d* is discontinued. Prerequisites for timing t6 are that the end processing of the image forming section a has been completed, and that the recording medium P has passed between the driven roller 34 and the secondary transfer roller 36 and the post processing such as cleaning of the intermediate transfer belt has been completed.

<Switching from Black-only Image Forming Operation to Color Image Forming Operation>

Figure 5:
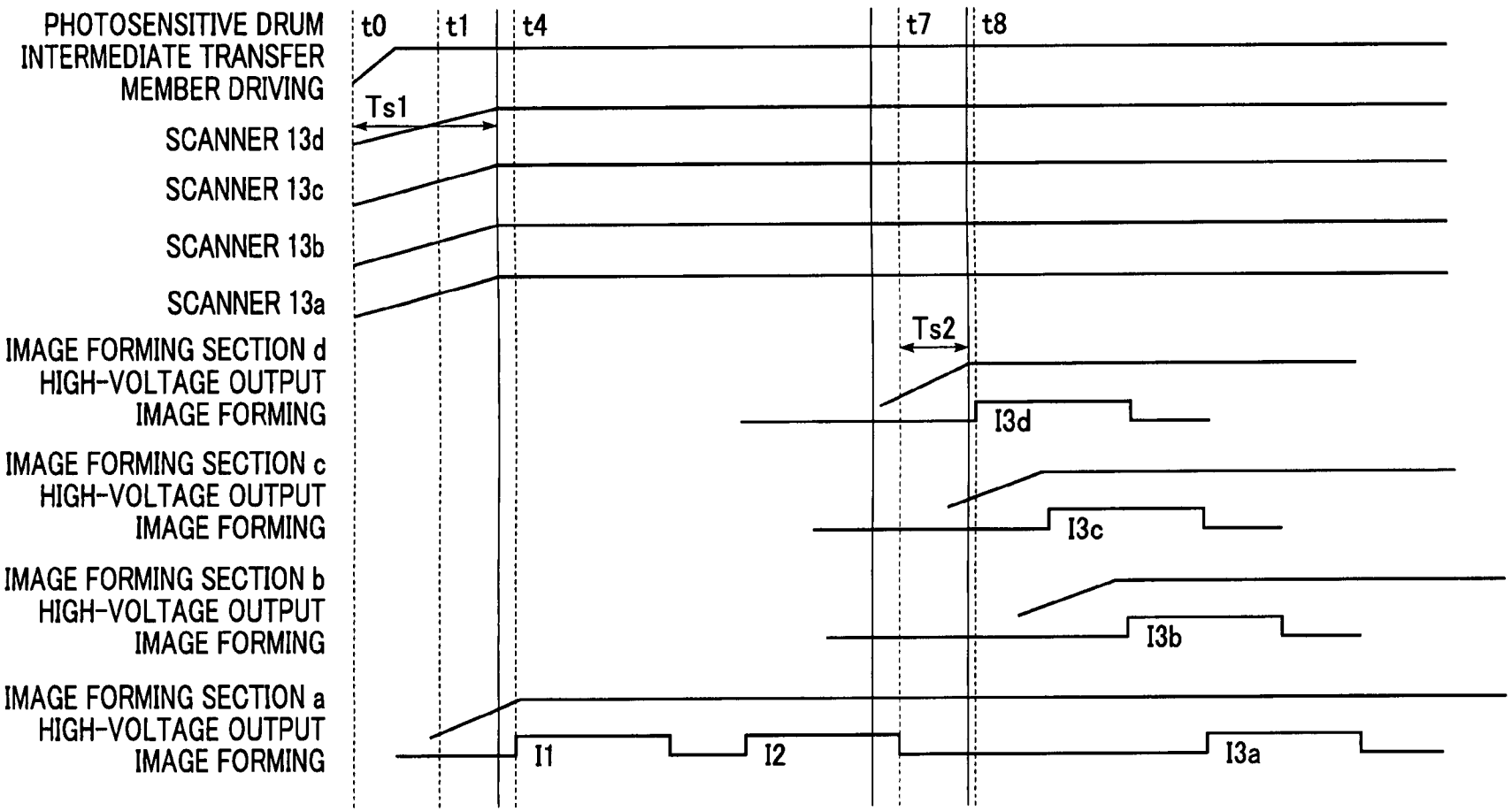
FIG. 5 is a timing chart illustrating the control timing of the image forming section in the case of switching from the black-only image forming operation to the color image forming operation of the image forming apparatus.

A case of switching over from black-only image forming operation to color image forming operation will now be described with reference to the timing chart shown in FIG. 5. FIG. 5 is a timing chart illustrating the control timing of the image forming sections a to d when switching over the operation from black-only image forming operation to color image forming operation. In FIG. 5, image forming cases II and I2 represent black-only image forming, and image forming cases I3 (I3*a*, I3*b*, I3*c* and I3*d*) represent color image forming.

The process prior to image forming I1 is the same as in the case described with reference to FIG. 4. After image forming I3 is determined to be color image forming, a high voltage is prepared for the image forming section d. Timing t7 for starting preparations for image forming of the image forming sections is after image forming I3 is determined to be color image forming, and the timing of completion of preparations for image forming of the image forming section d is after timing t8 subsequent to the completion of image forming I2 (time Ts2).

After the completion of image forming I2, the scanners 13*a* to 13*d* execute synchronization processing. After the completion of the synchronization processing of the scanners 13*a* to 13*d*, and after the completion of preparations for image forming of the image forming section d, image forming I3 of the image forming section d is started. As in the case shown in FIG. 3, preparations for image forming of the image forming section c and the image forming section b are started with an interval of time Tst from timing t7, and images of image forming cases 13*c* and 13*b* are sequentially formed. Finally, image forming I3*a* is executed. When the operation is switched over from black-only image forming operation to color image forming operation, the interval between image forming runs becomes longer, thus leading to a decrease in productivity of image forming.

<Switching from Color Image Forming Operation Mode to Black-only Image Forming Operation Mode>

Figure 6:
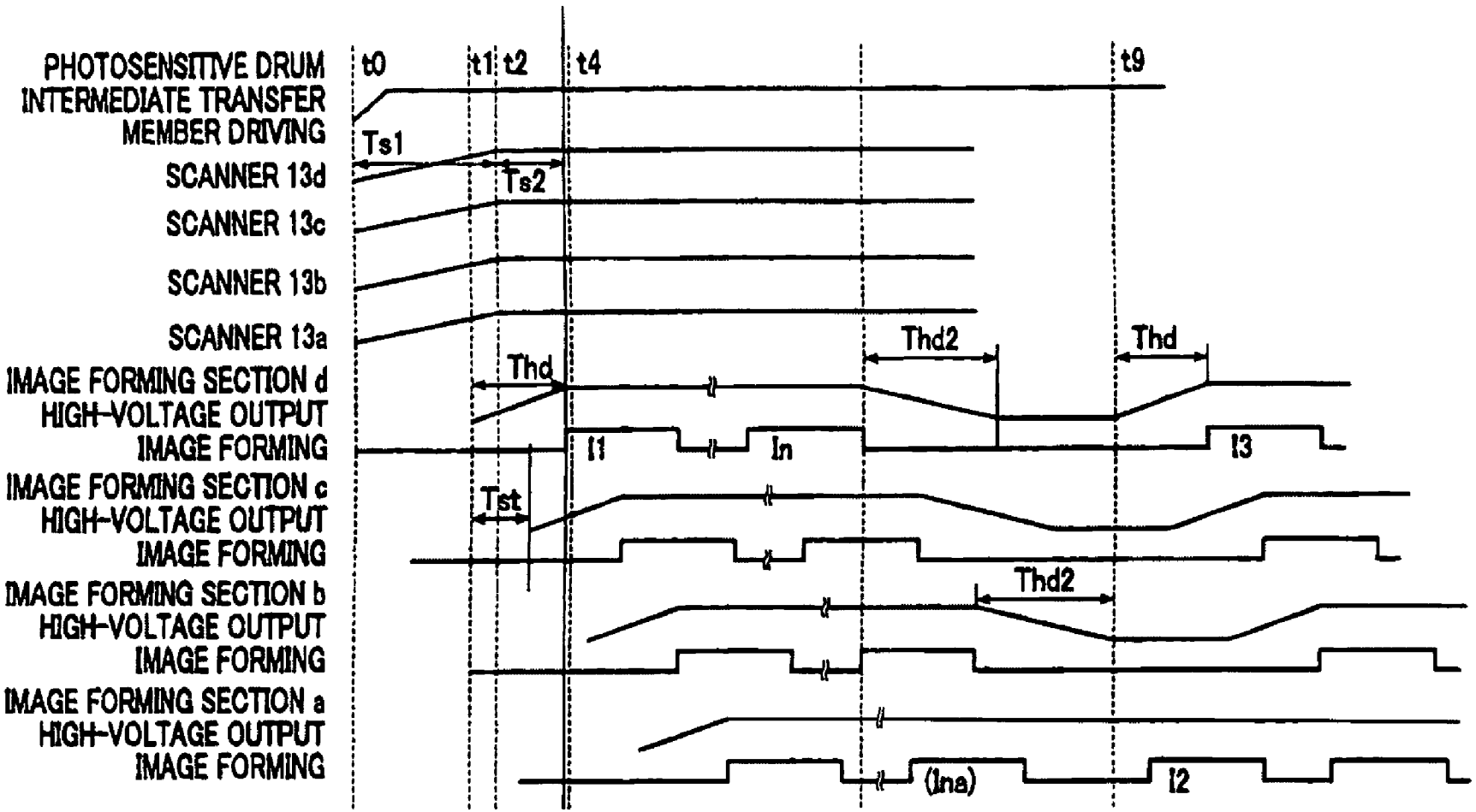
FIG. 6 is a timing chart illustrating the control timing of the image forming section in the case of switching the mode from the color image forming mode to the black-only image forming mode, and then switching to the color image forming operation.

A case of switching over the operation from color image forming operation mode to black-only image forming operation mode will now be described with reference to the timing chart shown in FIG. 6. FIG. 6 is a timing chart illustrating the control timing of the image forming sections a to d when switching over the operation from color image forming operation mode to black-only image forming mode. In FIG. 6, image forming cases I1 and In represent the operation in the color image forming operation mode, and image forming case I2 represents the operation in the black-only image forming operation mode.

The process before image forming I1 is the same as in the case described with reference to FIG. 3. After image forming I2 is determined to be in the black image forming operation mode, and after the completion of image forming In of the image forming section d, application of high voltages of the image forming section d is sequentially discontinued in the reverse order as that of the preparations for image forming. Application of high voltages in the image forming sections c and b is sequentially discontinued by delaying time Tst between the image forming section stages from the start of end of high-voltage impression of the image forming section d. After the completion of image forming Ina in the image forming section a, image forming I2 is started upon the lapse of time Thd2 before the end of the end processing (breaking processing) of high voltage application.

Before stabilization of output during end processing of high voltage application and preparing processing, toner not necessary for the image forming sections d, c and b is discharged and may adhere to the intermediate transfer belt 30. To avoid this inconvenience, image forming I2 is prevented from overlapping the position of the intermediate transfer belt 30 during end processing of high voltages of the image forming sections d, c and b. When executing switching from the color image forming operation mode to the black image forming operation mode, as described above, the interval between images becomes larger than that between usual images by a difference from time Thd2, thus resulting in a lower productivity of image forming.

<Switching from Color Image Forming Operation Mode to Black-only Image Forming Operation Mode, Followed by Switching again to Color Image Forming Operation Mode>

A case where the color image forming operation mode is switched over to the black-only image forming operation mode, and the operation is further switched over to the color image forming operation mode, will now be described with reference to the timing chart shown in FIG. 6.

Preparations for high voltage of the image forming sections d, c and b are made so as to avoid overlapping the image of image forming I2 transferred onto the intermediate transfer belt 30. At a timing t9 after the lapse of the image forming time of image forming I2 from the point in time of the completion of high voltage end processing of the image forming section d, the high voltage preparing operation of the image forming section d is started. For the image forming sections c and b, preparations for image forming are sequentially started by delaying time Tst between the image forming section stages from timing t9. After the lapse of time Thd from timing t9 when preparations for image forming of the image forming section d are completed, image forming I3 is started. Unlike the case shown in FIG. 5, no further processing is made after the synchronizing processing of the scanners 13*d*, 13*c*, 13*b* and 13*a* upon switching over from the color image forming made to the black-only image forming mode. It is not, therefore, necessary to perform a synchronizing processing after the completion of image forming for image forming I2.

As described above with reference to FIGS. 5 and 6, the interval between image forming runs must be enlarged as compared with usual operation when switching over between the color image forming operation mode and the black-only image forming operation mode. This leads to a lower productivity of image forming. When black-only image forming is carried out in the color image forming operation mode, the surfaces of the photosensitive drums 11*d*, 11*c* and 11*b* are scraped off under the effect of discharge caused by charging of the image forming sections d, c and b by the roller chargers 12*d*, 12*c* and 12*b*. In addition, driving of the developing units 14*d*, 14*c* and 14*b* in a developing state causes deterioration of the magnetic members in the developing units. Therefore, the service life of the image forming sections can be improved by discontinuing impression of high voltages to image forming sections not in use and stopping driving of the developing units 14*d*, 14*c* and 14*b*.

As described above, the service life of the image forming sections is dependent on a plurality of factors including scraping of the surfaces of the photosensitive drums and deterioration of the magnetic members in the developing units. These plurality of factors in turn depend upon service conditions thereof. For example, scraping of the surfaces of the photosensitive drums depends upon the charging time, and deterioration of the magnetic members in the developing units depends upon the driving time of the developing units. In this case, times required for turning on or off charging of the photosensitive drums or driving of the developing units form separate periods of time. In general, the time required for stopping driving of the developing units is shorter than the time required for turning on or off charging of the photosensitive drums.

For example, in this embodiment, the image forming preparation time (high voltage preparation time) Thd of the image forming section is about 1.4 seconds; the time to the completion of the high voltage end processing (high voltage end time) Thd2 is about 1.9 seconds; and the stopping time of driving/starting time of driving of the developing unit is about 0.15 seconds. Furthermore, it is easier to extend the service life of the photosensitive drums than to achieve a longer service life of the developing units. In this embodiment, when black-only image forming is performed from the color image forming operation mode (first image forming means) for forming a color image, an operation mode (third image forming means) which inhibits deterioration of the service life of the image forming section which stops a part of the functions of the yellow, magenta and cyan image forming sections of the color image forming operation, is executed from the color image forming operation mode.

Figure 7:
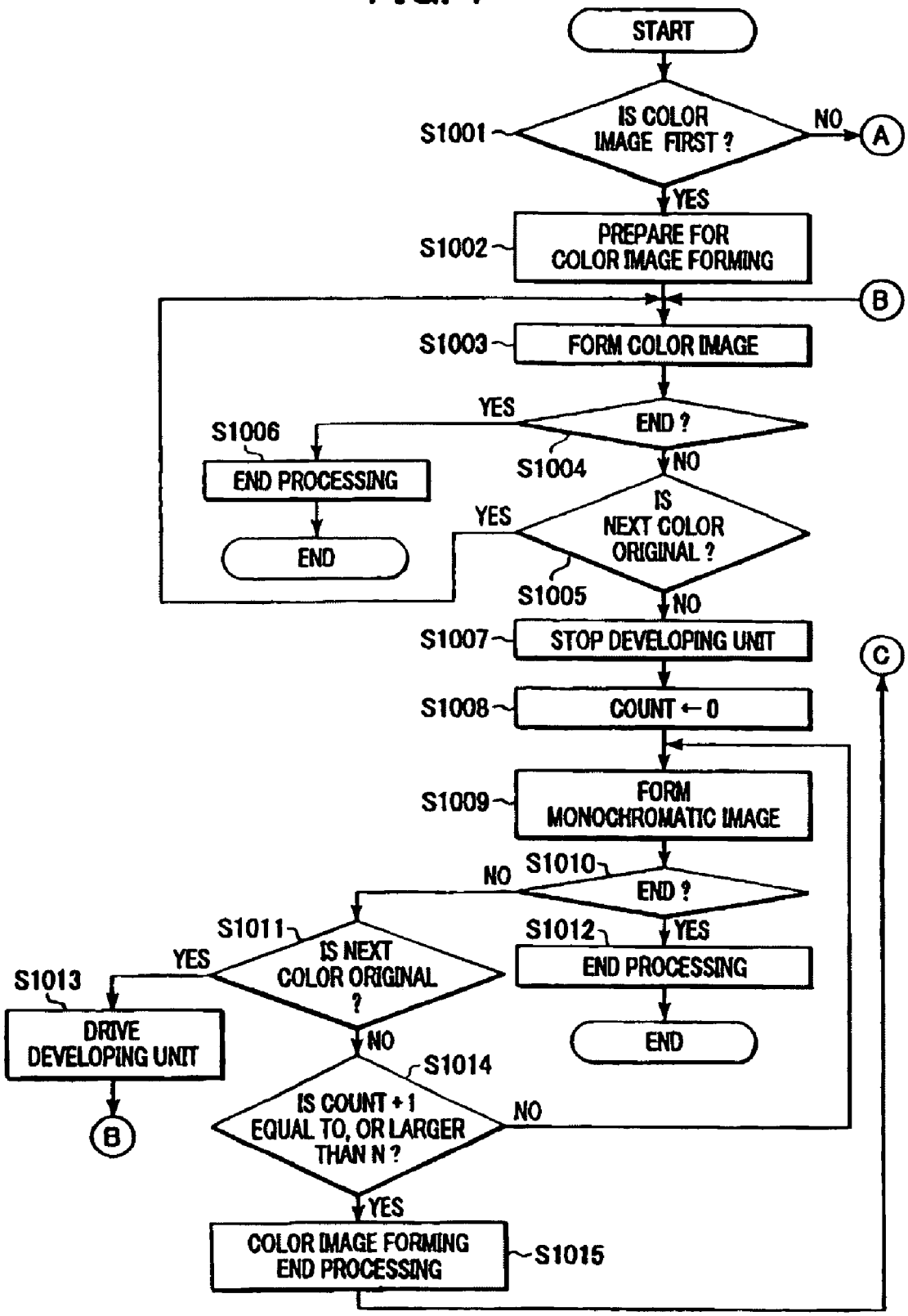
FIG. 7 is a flowchart illustrating the image forming processing of the image forming apparatus in the first embodiment of the present invention.
Figure 8:
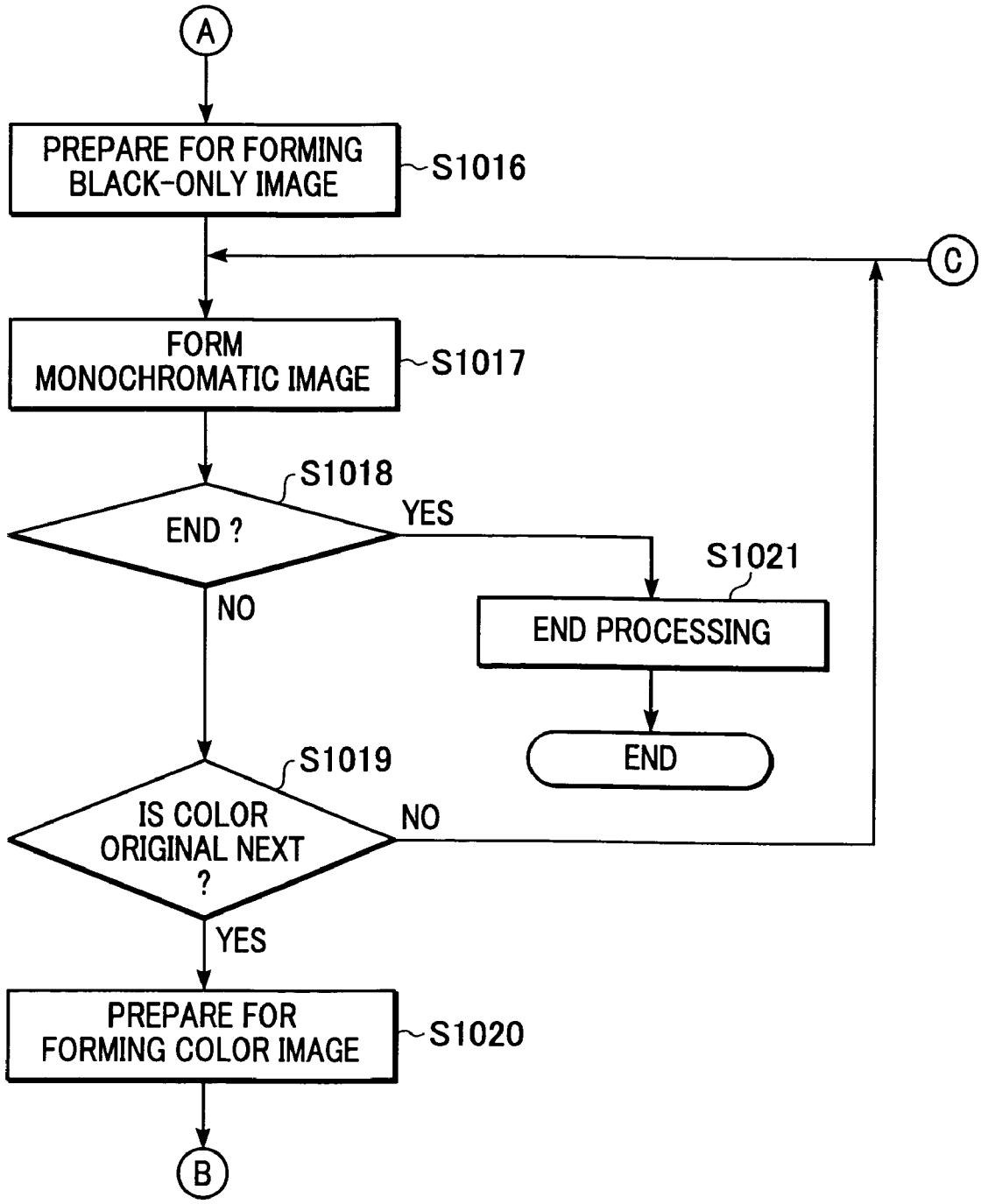
FIG. 8 illustrates the latter part of the flowchart shown in FIG. 7.

FIGS. 7 and 8 are flowcharts illustrating characteristic control of the first embodiment. The processing shown in the flowcharts of FIGS. 7 and 8 comprises executing a control program stored in the ROM 205 of the image forming apparatus by the CPU 201 by using the RAM 206. The control program is read and executed in accordance with the main sequence executed by the CPU 201, or as required.

First, in step S1001, it is determined whether or not the image of the first sheet of the recording medium is a color image. When the image is determined to be a color image in step S1001, the process advances to step S1002. When the image is determined not to be a color image in step S1001, the process goes to step S1016. In step S1002, preparations are made for color image forming as described with reference to the timing chart of FIG. 3. If preparations for color image forming are completed in step S1002, the process moves to step S1003 to form one color image. After forming the color image in step S1003, the process advances to step S1004.

In step S1004, it is determined whether or not the image currently formed is a final image. When the image is determined to be the final one, the process advances to step S1006. An end processing is carried out with reference to the timing chart of FIG. 3, and the process goes to the exit of this flowchart. When the image is determined not to be the final image in step S1004, the process goes to step S1005. In step S1005, it is determined whether or not the next original image is a color original image. When the next original image is determined to be a color original image in step S1005, the process goes to step S1003 to form a color image. If the next original image is determined not to be a color original image in step S1005, the process advances to step S1007.

In step S1007, the developing units 14*d*, 14*c* and 14*b* of the image forming sections d, c and b are stopped. In this case, stoppage must be made after the lapse of the time corresponding to the interval between the image forming section stages. In step S1008, a counter (COUNT) which counts the number of sheets of image forming is set at 0. In step S1009, a monochromatic image is formed. Thereafter, the process advances to step S1010. In step S1010, it is determined whether or not the currently formed image is the final one. When it is determined to be the final image in step S1010, the process goes to step S1012, and an end processing is carried out as described with reference to the timing chart shown in FIG. 3. The process escapes to the exit of the flowchart. If the currently formed image is determined not to be the final one in step S1010, the process advances to step S1011.

In step S1011, it is determined whether or not the next image is a color image. When it is determined to be a color image in step S1011, the process moves to step S1013. In step S1013, the developing units stopped in step S1007 are driven, and the process goes back to step S1003. If the next image is determined not to be a color image in step S1011, the process goes to step S1014. In step S1014, one is added to the above-mentioned counter (COUNT), and it is determined whether or not the counter value is larger than a prescribed number of sheets N. The prescribed number of sheets N may be set appropriately. When N is set at a larger value, an image of black only is formed in a state in which high voltages are outputted to the color image forming sections d, c and b. This leads to serious surface scraping of the photosensitive drums 11*d*, 11*c* and 11*b*. However, this results in a higher productivity of image forming when colors are mixed. For example, when N is assumed to be 3 in this processing, image forming is conducted in a state in which high voltages are outputted for the color image forming sections d, c and b until three originals not having a color image are successively delivered.

When the count value of the counter is determined not to be larger than the prescribed number of sheets N in step S1014, the process moves back to step S1009. When the counter value of the counter is determined to be larger than the prescribed number of sheets N, the process advances to step S1015 to carry out the end process (breaking processing) of high voltage impression of the image processing sections d, c and b as described above with reference to the timing chart shown in FIG. 6, and the process goes to step S1017. When the image is determined not to be a color image in step S1001, preparations for black-only image forming are made as described above with reference to the timing chart shown in FIG. 4 in step S1016. Thereafter, the process advances to step S1017 to form a single monochromatic image.

Subsequently, the process goes to step S1018. In step S1018, it is determined whether or not the currently formed image is the final one. When it is determined to be the final image in step S1018, the process advances to step S1021 to conduct an end processing as described above with reference to the timing chart shown in FIG. 4, and the process moves to the exit of the flowchart. When the currently formed image is determined not to be the final one in step S1018, the process advances to step S1019 to determine whether or not the next image is a color image. When the next image is determined not to be a color image in step S1019, the process returns to step S1017. When the next image is determined to be a color one in step S1019, preparations for image forming (step S1020) of the image forming sections d, c and b are sequentially made as described above with reference to the timing charts shown in FIGS. 5 and 6, and the process goes back to step S1003.

According to the first embodiment, as described above, there is provided an advantage of permitting extension of the machine service life while improving the productivity of image forming by immediately discontinuing operation for a short stoppage/driving time upon determination of monochromatic image forming from among factors having an effect on the machine service life in the image forming apparatus, and stopping operation for a long stoppage/driving time when performing monochromatic image forming on a prescribed number of sheets of the recording medium.

In the first embodiment, cases of extending the machine service life have been described with two types of control including the control regarding charging of the photosensitive drums 11*d*, 11*c*, 11*b* and 11*a*, and the control regarding driving of the developing units 14*d*, 14*c*, 14*b* and 14*a*. A similar control may be performed also for any other factor of service life. For example, if the photosensitive drums 11*d*, 11*c*, 11*b* and 11*a* are driven independently of each other, driving may be discontinued. When there is a mechanism available for separating the contact between the photosensitive drums 11*d*, 11*c*, 11*b* and 11*a* and the intermediate transfer belt 30, contact/separation between the photosensitive drums and the intermediate transfer belt may be conducted.

[Second Embodiment]

A second embodiment of the present invention will now be described. Unlike the above-mentioned first embodiment, the second embodiment covers a case where determination of whether or not the next original for image forming is a color one can be made only before starting of image forming. The entire configuration (FIG. 1) and the configuration of the controller (FIG. 2) of the image forming apparatus of the second embodiment are the same as in the first embodiment, and description is omitted here since the details have already been described.

Figure 9:
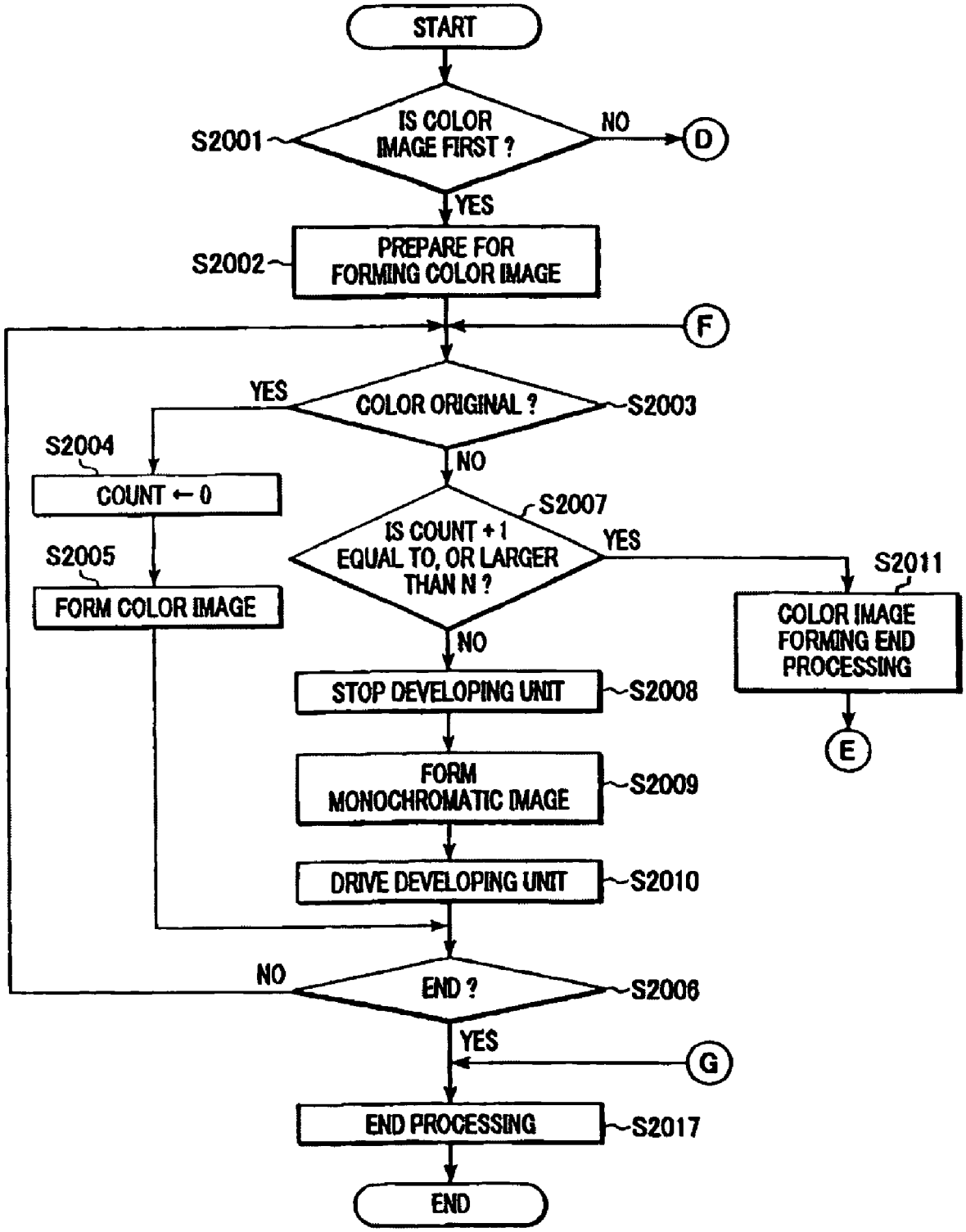
FIG. 9 is a flowchart illustrating the image forming processing of the image processing apparatus of a second embodiment of the present invention.
Figure 10:
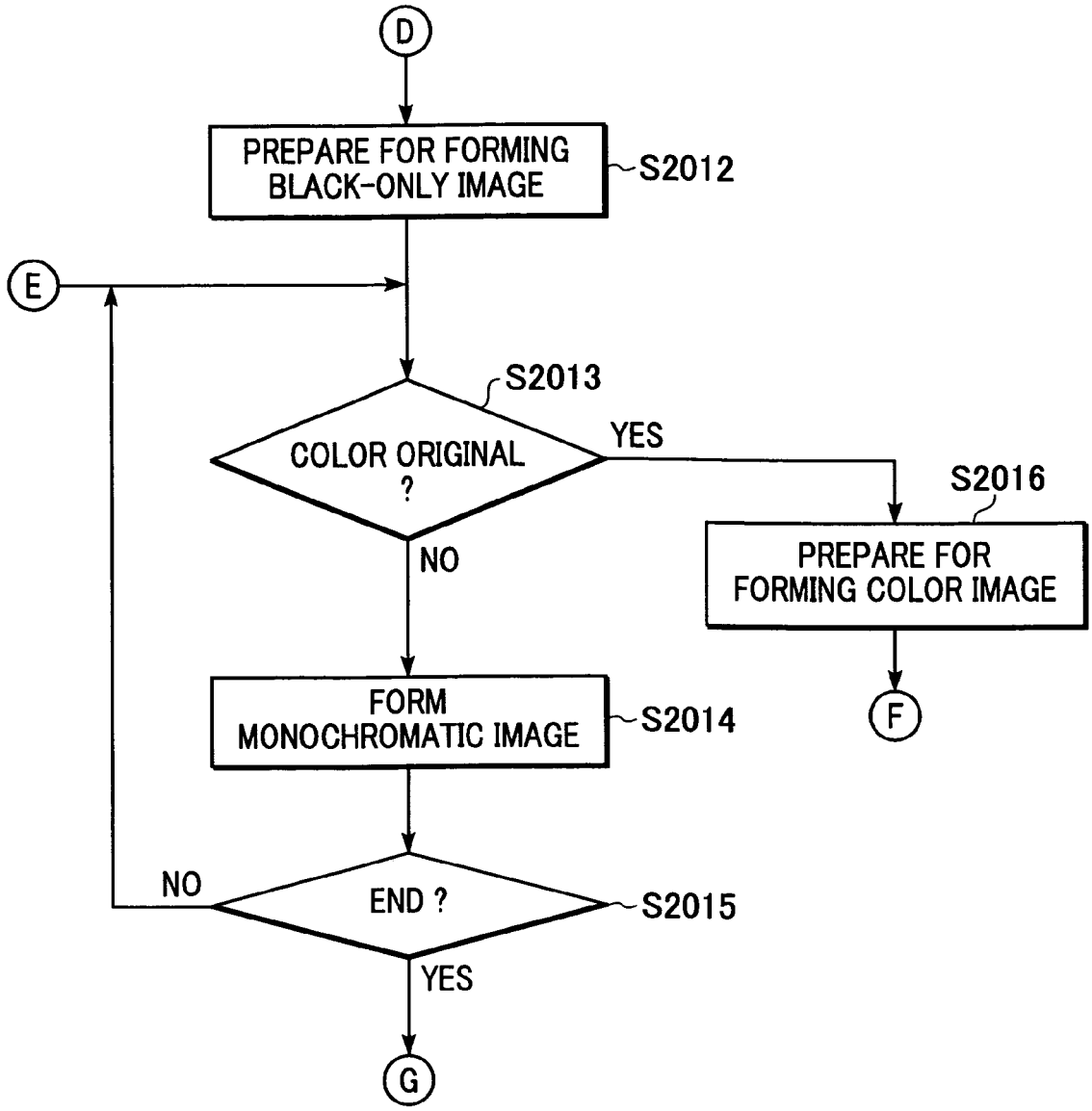
FIG. 10 illustrates the latter part of the flowchart shown in FIG. 9.

FIGS. 9 and 10 are flowcharts illustrating characteristic control of the second embodiment. The steps of processing shown in the flowcharts illustrated in FIGS. 9 and 10 are carried out by executing the control program stored in the ROM 205 of the image forming apparatus by the CPU 201 using the RAM 206. The control program is executed in accordance with a main sequence executed by the CPU 201 or reading out the same as required.

First in step S2001, it is determined whether or not the first sheet of recording medium covers a color image. When it is determined to be a color image in step S2001, the process advances to step S2002. In step S2002, preparations for color image forming are made and the counter (COUNT) described later is reset to zero as described above with reference to the timing chart shown in FIG. 3. When the preparations for color image forming are completed in step S2002, the process advances to step S2003 to determine whether or not the original image to be formed is a color original image. When the original image is determined to be a color original image in step S2003, the process goes to step S2004.

In step S2004, zero is set in the counter (COUNT), and the process advances to step S2005. In step S2005, a color image is formed. Upon the completion of forming of a single image by the image forming sections in step S2005, the process advances to step S2006. In step S2006, it is determined whether or not the currently formed image is the final image. When the image is determined to be the final one in step S2006, the process moves to step S2017, to perform a completing processing as described above with reference to the timing chart of FIG. 3, and the process goes to the exit of this flowchart. When the image is determined not to be the final original, the process returns to step S2003, and it is determined whether or not the original image is a color original image at the timing for starting image forming.

When the image is determined not to be a color original image in step S2003, the process moves to step S2007. In step S2007, one is added to the counter (COUNT), and it is determined whether or not the counter value added with one is larger than a prescribed value N. When the counter value added with one as above is determined not to be larger than the prescribed value N in step S2007, the process goes to step S2008. In step S2008, the developing units are stopped, and the process advances to step S2009.

In step S2009, a monochromatic image is formed. When forming of a single image is completed in step s2009, the process moves to step S2010. In step S2010, the developing units are driven, and the process goes to step S2006. When the counter (COUNT) value added with one as above is determined to be larger than the prescribed value N in step S2007, the process advances to step S2011. In step S2011, an end processing of high voltage impression of the image forming sections d, c and b is carried out, and the process goes to step S2013.

When the image is determined not to be a color image in step S2001, the process moves to step S2012. In step S2012, preparations for black-only image forming are made as described above with reference to the timing chart of FIG. 4. Thereafter, the process goes to step S2013. In step S2013, it is determined whether or not the original image for image forming is a color original image. When it is determined to be a color original image in step S2013, the process advances to step S2016, preparations for image forming for the image forming sections d, c and b are made sequentially as described above with reference to the timing charts of FIGS. 5 and 6, and the process goes to step S2003. When the image is determined not to be a color original image in step S2013, the process advances to step S2014 to from a single monochromatic image.

Upon the completion of image forming of a single sheet in step S2014, the process advances to step S2015, and it is determined whether or not the currently formed image is the final one. When the image is determined to be the final image in step S2015, the process moves to step S2017 to carry out an end processing as described above with reference to the timing chart of FIG. 3. The process then goes to the exit of this flowchart. When the image is determined not to be the final original in step S2015, the process returns to step S2013.

According to the second embodiment of the present invention, as described above, even when determination of whether or not the original image for forming an image is color can be made only at the timing of starting image forming, it is possible to prevent a delay in start of image forming by driving again the developing units after the end of the preceding run of image forming to stop again the developing units when the image is determined not to be color image forming at the timing of the second image forming, and to start driving of the developing units after determination thereof as being color image forming at the timing of start of image forming, and there is provided an advantage of permitting extension of the machine service life while improving the productivity of image forming as in the above-mentioned first embodiment.

[Other Embodiments]

In the above-mentioned embodiments, the indirect transfer method comprising one transferring an image from the photosensitive drums onto the intermediate transfer belt, and then transferring the image on the intermediate transfer belt onto the recording medium, has been adopted as the transfer method for the image forming apparatus. The present invention is not, however, limited to the indirect transfer method, but is applicable also to the direct transfer method in which the image on the photosensitive drum is transferred directly onto the recording medium.

In the above-mentioned embodiments, cases using the electrophotographic method as the image forming method of the image forming apparatus have been presented. The present invention is not, however, limited to the electrophotographic method, but is applicable also to various other image forming methods, including the electrostatic recording method and the ink-jet method.

In the above-mentioned embodiments, cases where the image forming apparatus is a copying machine have been presented as examples, but the present invention is not limited to the copying machine, but is also applicable, for example, a printer or a composite machine.

The object of the present invention can be achieved also by executing program codes stored in a memory medium by a computer of the system or the apparatus (a CPU or an MPU) through supply of the memory medium storing the program codes of software for achieving functions of the embodiments.

In this case, the program code itself read out from the memory medium is to achieve the functions of the above-mentioned embodiments so that the memory medium storing the program code serves as a component of the present invention.

Applicable memory media for supplying program code include, for example, a floppy (registered trademark) disk, a hard disk, an optomagnetic disk, a CD-ROM, a CD-R, a CD-RW, a DVD-ROM, a DVD-RAM, a DVD-RW, a DVD+RW, a magnetic tape, a nonvolatile memory card, and a ROM.

Examples to which the present invention are applicable also include a case where the functions of the above-mentioned embodiments are achieved through execution of program code read out by a computer, and an OS (operating system) or the like, operating on the computer, performs all or part of actual processing on the basis of instruction of the program code, and the functions of the above-mentioned embodiments are achieved by such processing.

Examples also include cases where the program code read out from the memory medium is written in a function expanding board inserted into the computer or a memory of the function expanding unit connected to the computer, and a CPU or the like provided in such a function expanding board or function expanding unit performs all or part of actual processing on the basis of instruction of the program code, and such processing achieves functions of the above-mentioned embodiments.

According to the present invention, as described above, when carrying out prescribed image forming from first image forming means which conducts image forming by means of two or more image forming sections from among a plurality of image forming sections, control is performed by switching over the operation to third image forming means which conducts image forming by stopping a part of the functions of the image forming sections from the first image forming means, and after image forming of a prescribed number of sheets by the third image forming means, the operation is switched over to second image forming means which performs image forming by means of a single image forming section from among a plurality of image forming sections. As a result, when conducting monochromatic image forming from the first image forming means (color image forming mode), it is possible to extend the machine service life while improving the productivity of image forming by carrying out image forming of a prescribed number of sheets by the third image forming means causing less service life deterioration of the color image forming sections with the first image forming means, thus permitting reduction of the running cost.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

first image forming means which controls at least two image forming sections from among a plurality of image forming sections to form an image by superimposing a plurality of colors;

second image forming means which controls a single image forming section from among the plurality of image forming sections to form a monochromatic image;

third image forming means which controls the single image forming section used by said second image forming means, and partially stops operation of the remaining image forming sections, to form a monochromatic image; and control means which, when causing image forming of the monochromatic image by said second image forming means by switching over said first image forming means to said second image forming means, causes image forming of the monochromatic image by said third image forming means only during a prescribed period of time.

2. The image forming apparatus according to claim 1, wherein said first image forming means controls at least two image forming sections to form a color image.

3. The image forming apparatus according to claim 2, wherein the at least two image forming sections form color images by use of a plurality of developing means including at least black developing means.

4. The image forming apparatus according to claim 3, wherein the at least two image forming sections form color images by using at least one image carrier and the plurality of developing means.

5. The image forming apparatus according to claim 1, wherein the single image forming section used by said second image forming means to form a monochromatic image uses only black developing means as developing means.

6. The image forming apparatus according to claim 5, wherein the single image forming section used by said second image forming means forms a monochromatic image by using the black developing means and image carriers associated therewith.

7. The image forming apparatus according to claim 1, further comprising a plurality of developing means, wherein stoppage of operation of the remaining image forming sections by said third image forming means causes stoppage of at least one of said developing means.

8. The image forming apparatus according to claim 7, wherein stoppage of the operation of the remaining image forming sections by said third image forming means causes stoppage of developing means of colors other than black.

9. The image forming apparatus according to claim 1, wherein service life deterioration of the plurality of image forming sections when operation is based on control by said third image forming means is less than the service life deterioration of the plurality of image forming sections when operation is based on control by said first image forming means.

10. The image forming apparatus according to claim 1, further comprising determining means which makes a determination of whether switching from a color image to a monochromatic image should occur, wherein, based on the determination by said determining means, a monochromatic image is formed by said second image forming means after control means switches over said first image forming means to said second image forming means during image forming of an image of a plurality of colors by said first image forming means.

11. The image forming apparatus according to claim 1, wherein the prescribed period of time is a period during which a prescribed number of images are formed.

12. The image forming apparatus according to claim 11, wherein the prescribed period of time can be set.

13. An image forming apparatus comprising:

first image forming means which superimposes images of a plurality of colors by controlling two or more image forming sections from among a plurality of image forming sections;

second image forming means which forms a monochromatic image by controlling a single image forming section from among the plurality of image forming sections;

third image forming means which forms a monochromatic image by controlling the single image forming section used by said second image forming means and partially stopping operation of the remaining image forming sections; and control means which, when causing image forming of the monochromatic image by said second image forming means by switching over said first image forming means to said second image forming means during image forming of a multicolor image by said first image forming means, causes image forming of monochromatic images only in a prescribed number by said third image forming means, and then causes image forming of a monochromatic image by said second image forming means.

14. An image forming apparatus comprising:

first image forming means which forms an image by superimposing a plurality of colors by controlling two or more image forming sections from among a plurality of image forming sections;

second image forming means which forms a monochromatic image by controlling a single image forming section from among the plurality of image forming sections;

third image forming means which forms a monochromatic image by controlling the single image forming section used by said second image forming means and partially stopping operation of the remaining image forming sections; and control means which, when causing image forming of the monochromatic image by said second image forming means by switching over said first image forming means to said second image forming means during image forming of images of a plurality of colors by said first image forming means, causes image forming of monochromatic images by said third image forming means, and then controls driving of the operation of the image forming sections stopped by said third image forming means.

* * * * *